United States Patent [19]

De Vigili

[11] 4,234,207

[45] Nov. 18, 1980

[54] SKI BRAKING DEVICE

[75] Inventor: Walter J. De Vigili, Roseville, Mich.

[73] Assignee: Louis E. Hough, Roseville, Mich.

[21] Appl. No.: 963,421

[22] Filed: Nov. 24, 1978

[51] Int. Cl.[3] ..... A63C 9/10

[52] U.S. Cl. ..... 280/605

[58] Field of Search ..... 280/604, 605, 11.37 G

[56] References Cited

U.S. PATENT DOCUMENTS

| | | | |
|---|---|---|---|
| 2,195,136 | 3/1940 | Simonsen et al. | 280/605 |
| 2,360,629 | 10/1944 | Varner | 280/605 |

FOREIGN PATENT DOCUMENTS

| | | | |
|---|---|---|---|
| 138050 | 2/1934 | Austria | 280/605 |
| 143813 | 6/1935 | Austria | 280/605 |
| 150331 | 3/1937 | Austria | 280/605 |
| 590755 | 6/1925 | France | 280/605 |
| 530943 | 8/1955 | Italy | 280/605 |

*Primary Examiner*—David M. Mitchell

*Attorney, Agent, or Firm*—Barnes, Kisselle, Raisch & Choate

[57] ABSTRACT

A braking device for a ski having two blades arranged in the shape of an inverted V resiliently hinged to a plate mounted on the rear end of a ski, the blades are adapted to pivot downwardly and dig into the snow when the ski tends to slide rearwardly. The blade closest to the rear end of the ski is narrower than the other so that it digs into the snow readily and the wider blade provides the necessary braking force.

6 Claims, 5 Drawing Figures

SKI BRAKING DEVICE

This invention relates to a device for preventing rearward movement of the skis on snow-covered surfaces.

In cross country skiing there is a need for preventing the skis from sliding rearwardly, such as when climbing a hill. Braking devices on skis for this purpose have heretofore been proposed. However, such devices have not been commercially successful. Such braking devices have, for the most part, been too complicated and costly. Perhaps the greatest reason why the devices as heretofore designed have not met with any degree of success resides in the fact that they are not effective in all types of snow. That is, they do not provide the necessary braking action on hard packed snow or provide too much drag on soft packed snow.

The present invention has for its object the provision of a braking device of the type described which is of economical manufacture, and, which, at the same time, provides the desired, effective and immediate braking action on any snow-covered surface without any substantial drag on the ski when travelling in a forward direction.

More specifically, the invention comprises a ski braking device having a pair of blades arranged in the shape of an inverted V resiliently hinged to a plate adapted to be mounted on the rear end of a ski. The blades project rearwardly from the rear end of the ski and, in use, normally incline slightly downwardly from the plane of the ski. The blade nearest the rear end of the ski is substantially narrower than the other blade and, thus, does not present any substantial drag when the ski moves forwardly. However, when the ski tends to move rearwardly, the narrower blade digs into the snow and pivots the entire brake so as to cause the wider blade to dig into the snow and produce the desired braking action.

Other objects, features and advantages of the present invention will become apparent from the following description and accompanying drawing, in which.

Figure 1:
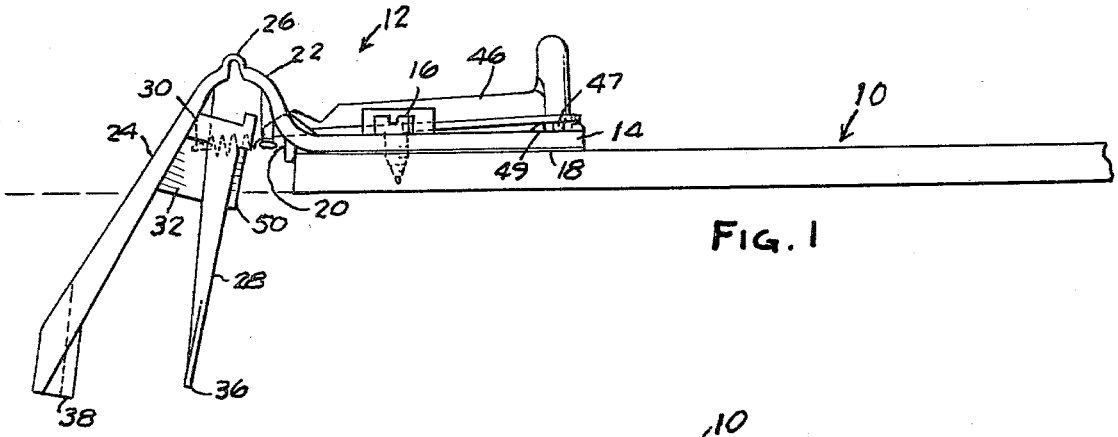
FIG. 1 is a side elevational view of the rear end of a ski having the braking device of the present invention mounted thereon.
Figure 2:
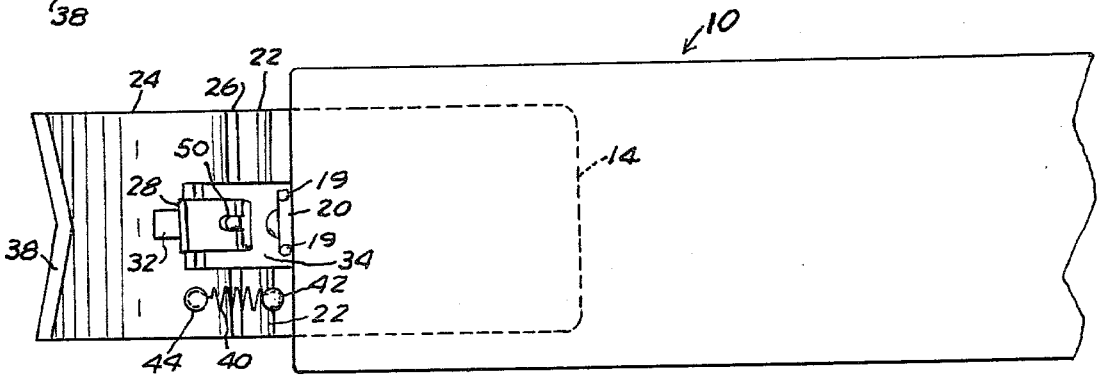
FIG. 2 is a bottom plan view of the ski and braking device shown in FIG. 1.

Referring to the drawing, a ski is generally designated 10 and has the braking device 12 of the present invention mounted at the rear end thereof. The braking device comprises a flat plate 14 adapted to be mounted on the top face of the ski at the rear end thereof by a pair of screws 16. It is also preferred to provide a layer of adhesive 18 on the bottom face of plate 14 for adherring the brake in the proper position on the ski prior to securing screws 16. The proper positioning of brake 12 on the rear end of the ski is facilitated by a pair of small pins 19 projecting downwardly from a lug 20 located at the rear end of plate 14 and overhanging the rear end of the ski. Pins 19 are adapted to abut against the rear edge of the ski as shown in FIGS. 1 and 2.

The rear end of plate 14 is formed at opposite sides of lug 20 with a pair of laterally spaced upward extensions

Figure 3:
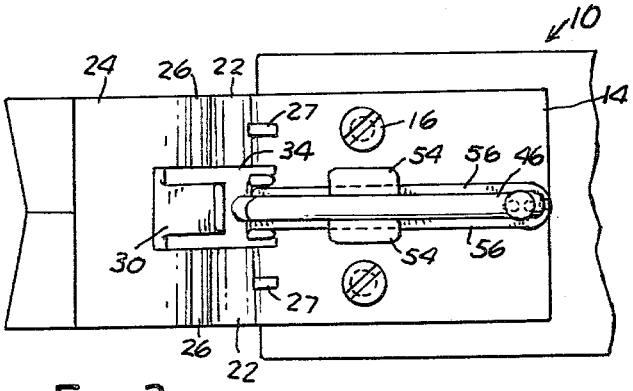
FIG. 3 is a top plan view of the ski and braking device shown in FIG. 1.
Figure 5:
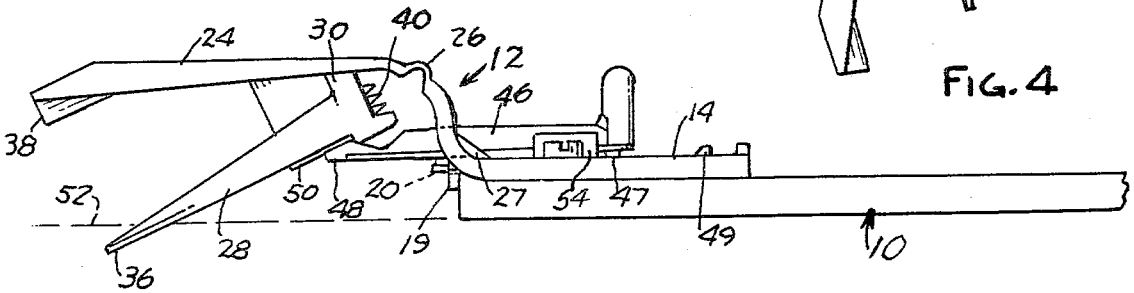
FIG. 5 illustrates the brake latched in the inoperative position.

22 connected with a downwardly extending blade 24 by a pair of U-shaped hinge sections 26. The laterally spaced hinge sections 26 are thinner than the adjacent sections of extensions 22 and blade 20 so as to provide a relatively freely hinging action of blade 24 relative to plate 14. Extensions 22 are rendered relatively rigid by gusset webs 27 (FIGS. 3 and 5). The brake is preferably molded from a plastic material and hinge sections 26 are, therefore, resilient so that in the free position of the device blade 24 projects downwardly as illustrated in FIG. 1.

A second blade 28 is connected to blade 24 adjacent to upper end thereof by a molded lug 30. The two blades 24,28 present the shape of an inverted V. The two blades are rendered rigid relative to one another by a relatively heavy lug 30 and a reinforcing gusset web 32.

As shown in FIG. 2, blade 28 is very narrow, preferably on the order of about $\frac{3}{8}$ inch wide, while blade 24 extends the full width of plate 14, that is, about $1\frac{1}{2}$ inches wide. As illustrated in FIGS. 2 and 3, blade 28 is narrower than the central opening 34 between the two extensions 22. Although blade 28 is relatively narrow, it is rendered relatively rigid by reason of the fact that it is of progressively increasing thickness in a direction upwardly from the free lower end 36 thereof. Blade 24 has its lower end 38 in the shape of a wide rearwardly facing V.

A tension spring 40 is connected between a lug 42 on the under side of one of the extensions 22 and a longitudinally aligned lug 44 on the underside of blade 24. The use of a single tension spring such as shown at 40 to bias blade 24 to the position shown in FIG. 1 is desirable in the event the plastic from which the brake device is molded tends to lose its resiliency. The loss of resiliency or elastic memory in hinge sections 26 may occur in the event the brake device is flexed to the released position shown in FIG. 5 for a prolonged period of time. The release position of the brake is obtained by pivoting blade 24 upwardly and sliding a latch 46 on plate 14 rearwardly so that the free end 48 thereof engages beneath a rib 50 on the under face of plate 28 and thus retains the blade assembly in the upwardly pivoted position illustrated in FIG. 5. In this position it will be observed that the free end 38 of blade 24 is disposed above the top surface 52 of the snow on which the ski is travelling and the lower end 36 of blade 28 penetrates only slightly into the snow surface 52. Latch 46 is slideably guided on the top face of plate 14 by a pair of lugs 54 which overlap longitudinally extending flanges 56 on latch 46. Latch 46 is retained in the inoperative position shown in FIG. 1 by interengaging detents 47,49.

In its free position mounted on the ski the braking device 14 assumes the position illustrated in FIG. 1. However, when the weight of a person is supported by the ski, the connected blades 24,28 will pivot about the hinge section 26 upwardly and rearwardly so that these blades will be inclined to the horizontal at an angle substantially less than illustrated in FIG. 1, but greater than the inclination shown in FIG. 5. The extent to which the blades 24,28 will be inclined to the horizontal will depend to a large extent upon the hardness of the surface of the snow over which the ski is travelling. If the snow is soft and fluffy, blades 24,28 will be inclined to the horizontal somewhat less than illustrated in FIG. 1. But, if the snow is hard packed, these blades will be inclined substantially less and, most likely, only blade 28 will penetrate the hard packed snow, but to an extent slightly greater than illustrate in FIG. 5. In soft packed snow, blade 24 might extend downwardly into the snow to some extent, but, since the snow is softly packed, it will not produce any substantial drag on the forward movement of the ski. In hard packed snow blade 24 will be spaced above the hard surface and the drag on the ski will be relatively light since blade 28 is relatively narrow.

Figure 4:
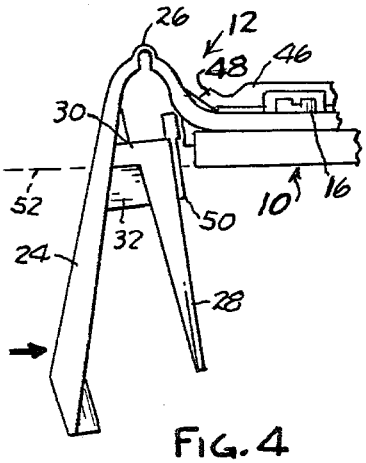
FIG. 4 shows the brake in the fully applied position.

In the event that the ski tends to slide rearwardly on the snow-covered surface, the lower end 36 of blade 28 will immediately dig into the snow and pivot the entire blade assembly about hinge section 26 in a downward and forward direction (counterclockwise as viewed in the drawing). Since blade 28 is relatively narrow, this pivoting action will occur substantially immediately, even in hard packed snow. It follows that, since blades 24,28 are rigidly interconnected, blade 24 will also be pivoted downwardly and dig into the snow. When this occurs, the wide blade 24 will provide the necessary braking force in the snow, even when the snow is soft, to prevent rearward movement of the ski. If the ski continues to move slightly in a rearward direction, the two blades 24,28 will assume the position illustrated in FIG. 4 wherein the ski is in the fully braked position. In this position the forward end of lug 30 abuts the rear face of the abutment lug 20. This interengagement of lugs 20,30 avoids excessive strain on screws 16. I have found that if blades 24,28 are inclined to one another at an included angle of about 20°, an excellent braking action is obtained without any substantial drag on the skis on either soft or hard packed snow.

I claim:

1. A braking device for preventing rearward movement of a ski, such as when climbing a hill, comprising, a plate member having a generally flat bottom face adapted to be fixedly mounted on the upper face of a ski at the rear end thereof, a brake member resiliently hinged to the rear end of said plate member, said brake member comprising a pair of downwardly projecting blades integrally connected together adjacent their upper ends in fixed relation adjacent the hinge, said blades having their free ends normally projecting downwardly and rearwardly from the rear end of said plate member and being spaced apart in a direction lengthwise of the plate member, the blade closest the rear end of the plate member being substantially narrower and normally inclined downwardly at a greater angle to the plane of the ski than the blade more remote from the rear end of the ski, said narrower blade being adapted to engage the snow surface over which the ski is travelling, whereby, when the ski tends to move rearwardly on a snow-covered surface, the narrower blade promptly digs into the underlying snow and thereby causes the brake member as a whole to pivot downwardly and forwardly about said hinge so that the wider blade digs progressively deeper into the snow and thereby produces a substantial braking action against rearward movement of the ski, said plate member and said brake member comprising an integral one-piece plastic molding and said hinge comprising a thinned section between the plate member and the brake member.

2. A braking device as called for in claim 1 wherein said hinge is of generally inverted U shape and extends upwardly from the rear end of said plate member, one leg of the U being integrally connected with the plate member and the other leg being connected to the brake member, said U-shaped hinge being resiliently flexible to provide said resiliently hinged connection.

3. A braking device as called for in claim 2 including spring means acting between the brake and plate members and normally biasing the brake member in a direction downwardly and forwardly relative to the plate member to cause said narrower blade to engage the snow surface over which the ski is travelling.

4. A braking device as called for in claim 3 wherein said spring means comprises a tension spring extending between said plate and brake members adjacent said U-shaped hinge.

5. A braking device for preventing rearward movement of a ski, such as when climbing a hill, comprising, a plate member having a generally flat bottom face adapted to be fixedly mounted on the upper face of a ski at the rear end thereof, a brake member resiliently hinged to the rear end of said plate member, said brake member comprising a pair of downwardly projecting blades integrally connected together adjacent their upper ends in fixed relation adjacent the hinge, said blades having their free ends normally projecting downwardly and rearwardly from the rear end of said plate member and being spaced apart in a direction lengthwise of the plate member, the blade closest the rear end of the plate member being substantially narrower and normally inclined downwardly at a greater angle to the plane of the ski than the blade more remote from the rear end of the ski, said narrower blade being adapted to engage the snow surface over which the ski is travelling, whereby, when the ski tends to move rearwardly on a snow-covered surface, the narrower blade promptly digs into the underlying snow and thereby causes the brake member as a whole to pivot downwardly and forwardly about said hinge so that the wider blade digs progressively deeper into the snow and thereby produces a substantial braking action against rearward movement of the ski, and a latch member on said plate engageable with said brake member for retaining the brake member in an upwardly pivoted inoperative position, said latch member being mounted for sliding movement on the plate member in a direction longitudinally thereof, said latch member being slideable rearwardly to a position wherein the rear end of the latch is disposed beneath the thinner blade and retains the brake member in said upwardly pivoted inoperative position.

6. A braking device for preventing rearward movement of a ski, such as when climbing a hill, comprising, a plate member having a generally flat bottom face adapted to be fixedly mounted on the upper face of a ski at the rear end thereof, a brake member resiliently hinged to the rear end of said plate member, said brake member comprising a pair of downwardly projecting blades integrally connected together adjacent their upper ends in fixed relation adjacent the hinge, said blades having their free ends normally projecting downwardly and rearwardly from the rear end of said plate member and being spaced apart in a direction lengthwise of the plate member, said blade closest the rear end of the plate member being substantially narrower and normally inclined downwardly at a greater angle to the plane of the ski than the blade more remote from the rear end of the ski, said narrower blade being adapted to engage the snow surface over which the ski is travelling, whereby, when the ski tends to move rearwardly on a snow-covered surface, the narrower blade promptly digs into the underlying snow and thereby causes the brake member as a whole to pivot downwardly and forwardly about said hinge so that the wider blade digs progressively deeper into the snow and thereby produces a substantial braking action against rearward movement of the ski, said device comprising a one-piece plastic molding and said brake member including a web gusset section extending between the two blades adjacent the upper ends thereof.

* * * * *